US005546833A

United States Patent [19]

Holdeman et al.

[11] Patent Number: 5,546,833

[45] Date of Patent: Aug. 20, 1996

[54] SCREW DRIVE TOOL JOINT WRENCH

[75] Inventors: R. Brian Holdeman; Fred H. Kohman, both of Perry; Greg T. Harrison, Stillwater; Bradley W. Hise, Perry, all of Okla.

[73] Assignee: The Charles Machine Works, Inc., Perry, Okla.

[21] Appl. No.: 398,107

[22] Filed: Mar. 3, 1995

[51] Int. Cl.[6] ..... B25B 13/00

[52] U.S. Cl. ..... 81/52; 81/57.34

[58] Field of Search ..... 81/52, 57.34, 58.1, 81/58, 462

[56] References Cited

U.S. PATENT DOCUMENTS

| | | | |
|---|---|---|---|
| 443,312 | 12/1890 | Bode . | |
| 2,737,839 | 3/1956 | Paget . | |
| 3,122,952 | 3/1964 | Eliason . | |
| 3,752,016 | 8/1973 | Ballard . | |
| 3,880,024 | 4/1975 | Asada . | |
| 4,305,316 | 12/1981 | Lehman . | |
| 4,574,664 | 3/1986 | Curry | 81/57.34 |
| 5,062,326 | 11/1991 | Goldschmidt | 81/57.34 |
| 5,201,256 | 4/1993 | Schneider et al. | 81/57.34 |
| 5,231,899 | 8/1993 | Lee . | |
| 5,386,746 | 2/1995 | Hawk | 81/57.34 |

*Primary Examiner*—Willis Little

*Attorney, Agent, or Firm*—Richards, Medlock & Andrews

[57] ABSTRACT

A wrench (10) is disclosed for breaking a threaded connection between first and second pipe sections (14, 16) having wrench flats (18). A first jaw (20) is pivotally secured to a first torque arm (22) and slid over the wrench flats of the first pipe section. A second jaw (54) is pivotally secured to a second torque arm (56) and slid over the wrench flats of the second pipe section (16). A threaded rod (70), with a handle (72) thereon, is threaded between the distal ends of the torque arms so that the distal ends of the torque arms can be brought together by rotating the threaded rod with the handle to break the connection. The jaws (20, 54) are interchangeable and jaws of different size can be used to fit pipe sections of different diameter. Further, the jaws have a plurality of pivot pin apertures (26–38) around their circumference to permit the jaws to be adjusted on the torque arms to position the jaw on the wrench flats of the pipe sections. A fine adjustment is provided by using a pair of pivot pin apertures (46, 48) on the torque arms.

16 Claims, 2 Drawing Sheets

SCREW DRIVE TOOL JOINT WRENCH

TECHNICAL FIELD OF THE INVENTION

This invention relates to a wrench for breaking a pipe connection, particularly a pipe connection between pipe sections having wrench flats.

BACKGROUND OF THE INVENTION

In the field of horizontal boring to install utilities and the like, it is common to bore a hole through the earth from an entry point at the surface to an exit point at the surface at some distance away with a drill string made up of a series of pipe sections threaded together. Most commonly, these pipe sections have a pair of opposed notches formed in the outer diameter thereof near the ends to form wrench flats to facilitate in breaking and making the threaded connection between the pipe sections.

The force necessary to break the threaded connection is typically greater than the making of the connection because the connection is tightened as the drill sting bores through the earth. The entire drill string must be rotated in a direction to tighten the threaded connections in order to rotate the boring bit at the end of the drill string. A number of designs have been developed for breaking this threaded connection. However, a need exists for an inexpensive and readily usable mechanism for this purpose.

SUMMARY OF THE INVENTION

A wrench assembly is provided for breaking a threaded connection between a first pipe section and a second pipe section. The wrench assembly includes a first jaw engaged to the first pipe section for rotation therewith, and a first torque arm having a proximal end and a distal end. The proximal end is secured to the first jaw. A second jaw is engaged to the second pipe section for rotation therewith, and a second torque arm is provided which has a proximal end and a distal end. The proximal end of the second torque arm is secured to the second jaw. A threaded assembly is mounted between the distal ends of the first and second torque arms and moves the distal ends of the torque arms together to rotate the first and second pipe sections in opposite directions about their center axis to break the threaded joint.

In respect to another aspect of the present invention, the first and second jaws are removably secured to the first and second torque arms, respectively, and jaws sized to fit different size pipe sections can be mounted on the torque arms to break threaded connections of various diameter pipe sections.

In accordance with another aspect of the present invention, the torque arms are each provided with a pivot pin aperture at their proximal ends and the first and second jaws are provided with a plurality of pivot pin apertures about their circumference. A pivot pin secures each jaw to each torque arm at the pivot pin aperture in the torque arm and a selected pivot pin aperture in the jaw to provide an adjustable alignment with the pipe section. The torque arm can also have a plurality of pivot pin apertures to provide even greater adjustability.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION

Figure 1:
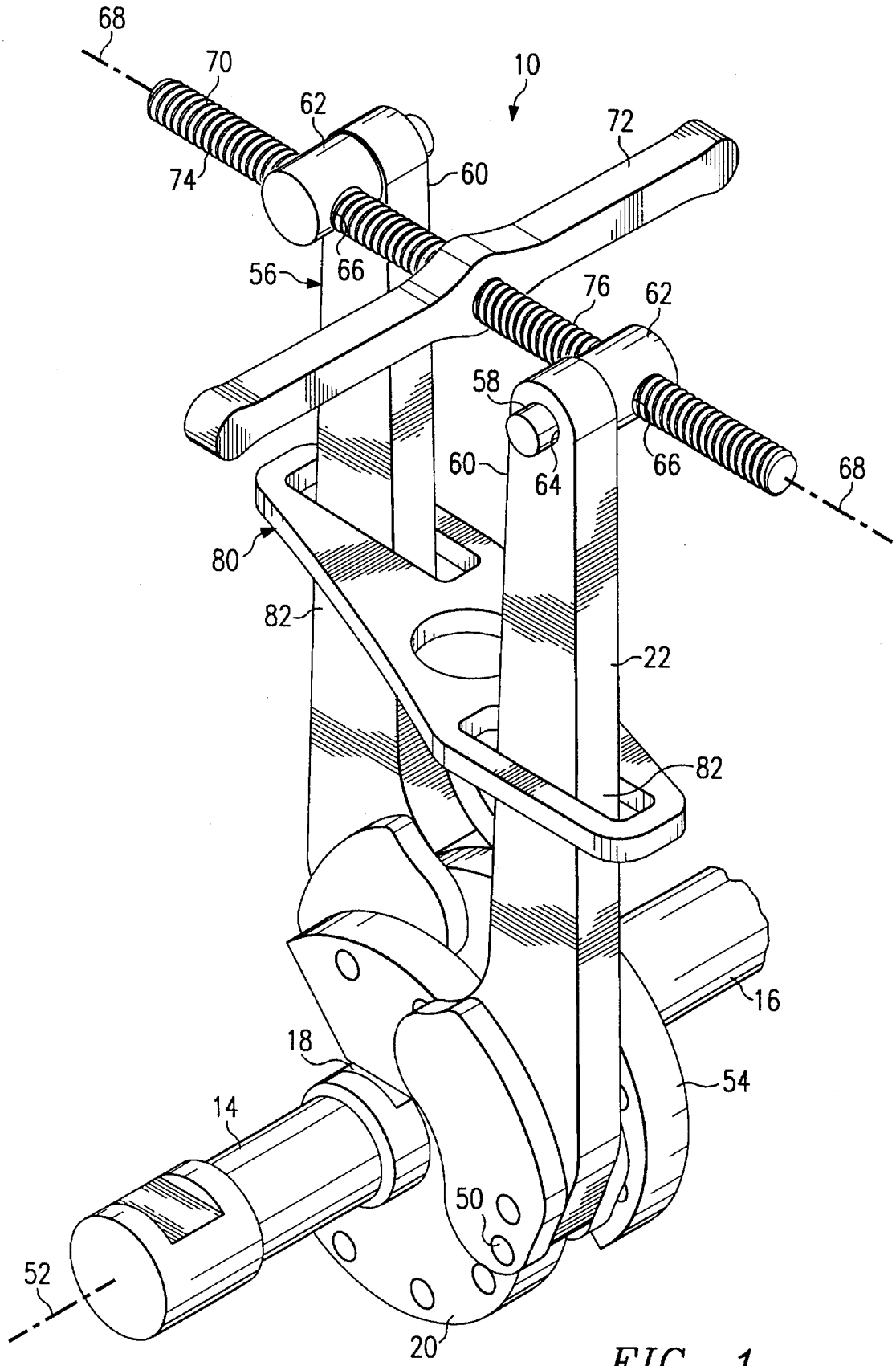
FIG. 1 is a perspective view of a tool joint wrench forming a first embodiment of the present invention.

With reference to FIG. 1, a screw drive tool joint wrench 10 is illustrated which forms a first embodiment of the present invention. The wrench 10 is used to break a threaded connection between a first pipe section 14 and a second pipe section 16. Each pipe section has opposed wrench flats 18 formed into the outer surface of the pipe sections proximate the end of the pipe sections forming the threaded connection.

Figure 2:
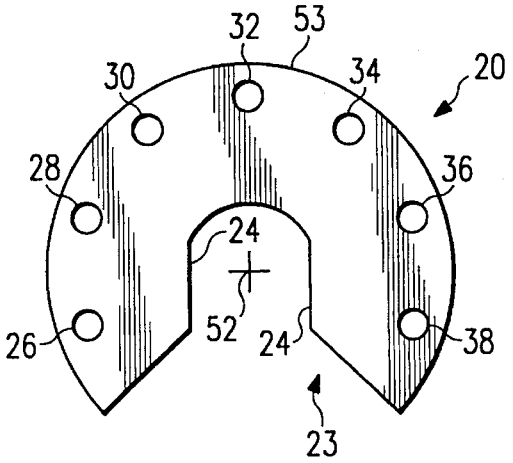
FIG. 2 is a plan view of a jaw used with the joint wrench of FIG. 1.
Figure 3A:
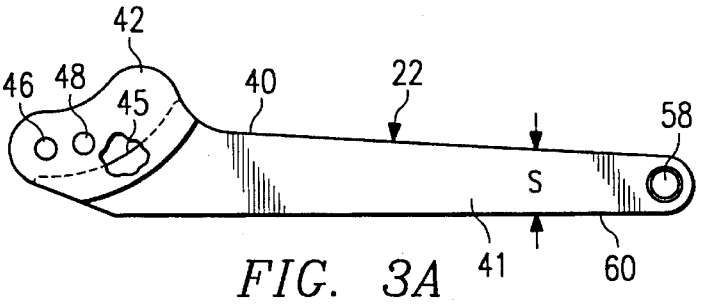
FIG. 3A is a plan view of a torque arm used with the joint wrench of FIG. 1.
Figure 3B:
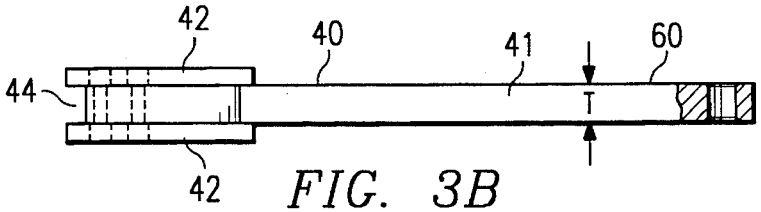
FIG. 3B is a side view of the torque arm of FIG. 3A.

The wrench 10 includes a first jaw 20 and a first torque arm 22. As best seen in FIG. 2, the first jaw has an arcuate configuration with an open side 23 defining opposed wrench flats 24 which are sized to closely engage the wrench flats 18 of the pipe sections so that, after the first jaw is slid over the pipe section at flats 18, the first jaw 20 will rotate the pipe section to break the threaded connection in a manner described hereinafter. About the circumference of the jaw are formed a series of pivot pin apertures 26–38.

The first torque arm 22 has a proximal end 40 and is formed of an elongate hockey stick shaped portion 41 and plates 42 welded on either side of portion 41 at the proximal end. The torque arm defines a slot 44, ending in curved surface 45 at the end of portion 41, to receive a portion of the first jaw 20. The plates 42 have a pair of aligned pivot pin apertures 46 and 48 as illustrated. The first jaw 20 is pivotally attached to the first torque arm 22 by a pin 50 inserted through one of the sets of apertures 46 and 48 and one of the apertures 26–38. Each of the apertures 26–38 is preferably positioned at a 36° angle about the center axis 52 relative to the adjacent aperture while the apertures 46 and 48 are positioned at an angle about 18° apart from each other about the axis 52. This provides a great deal of flexibility in attaching the wrench 10 on the pipe sections irrespective of the position of the wrench flats 18 on the pipe section.

The first jaw 20 is capable of limited pivotal motion relative to first torque arm 22 when secured thereto by pin 50. The motion is limited by contact between the outer surface 53 of first jaw 20 with the curved surface 45 on portion 41.

The wrench 10 also includes a second jaw 54 and a second torque arm 56 which are essentially identical to first jaw 20 and first torque arm 22.

An aperture 58 is formed through the first torque arm 22 at the distal end 60 thereof to receive a pivoting nut 62. A spring clip 64 holds the pivoting nut 62 on the first torque arm 22. Through a portion of the pivoting nut is formed a threaded aperture 66, preferably having an acme thread. A similar pivoting nut 62 is pivotally mounted on the distal end of the second torque arm 56 so that the apertures 66 of the pivoting nuts 62 are in alignment along an axis 68, which is generally perpendicular the axis 52. A threaded rod 70 with a handle 72 in the middle thereof is threaded into the apertures 66 of the pivoting nuts 62 so that the distal ends 60 of the torque arms can be moved together by rotating the rod 70 in one direction with the handle and moved apart by rotating the threaded rod 70 in the other direction with the handle. As can be understood, the threads 74 on a first side of the rod are opposite in pitch to the threads 76 on the opposite side of the rod 70. Both threads 74 and 76 are also preferably acme threads.

The wrench 10 is installed at the threaded connection between the first and second pipe sections 14 and 16, with the jaws 20 and 54 engaging the respective wrench flats of the pipe sections. When the distal ends of the torque arms are moved together by rotating the threaded rod 70, the threaded connection between the pipe sections will be broken if the pipe sections use right hand threads. To the contrary, if the distal ends of the torque arms are moved apart by rotating the threaded rod, the threaded connection with be tightened for right hand threads.

Figure 4:
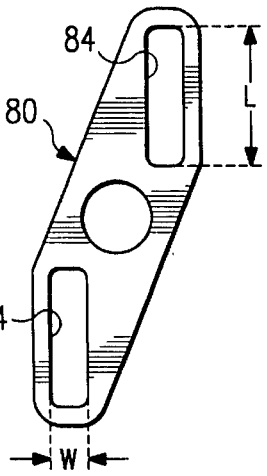
FIG. 4 is a plan view of a brace used with the joint wrench of FIG. 1.

The design as described above will work satisfactorily if the wrench flats 18 on the pipe sections are sufficiently close to the threaded connection so that the torque arms 22 and 24 do not twist as the threaded rod 70 is rotated. If the flats 18 are sufficiently distant to create such a twisting problem, a wrench brace 80 can be used which maintains the torque arms in the proper orientation for the best operation. As can be seen, the mid portions 82 of the torque arms have a generally rectangular cross-section. As seen in FIG. 4, the wrench brace 80 has a pair of rectangular apertures 84 formed therein on opposite sides of its axis of symmetry. The wrench brace 80 is installed over the torque arms as shown in FIG. 1 with each torque arm passing through one of the apertures 84. The width W of each aperture closely approximates the thickness T of each of the torque arms, while the length L of the apertures is generally longer than the span S of the torque arm so that the wrench brace can slide a considerable distance along the torque arms between their proximal and distal ends. With a close fit between the width W of the wrench brace 80 and the thickness T of the torque arms, the torque arms will be prevented from twisting as the threaded rod 70 is rotated to break the threaded connection.

The wrench 10 is readily adaptable to wrench flats 18 of different distances from the threaded connection by simply providing pivoting nuts 62 of sufficient length to provide the necessary separation between the jaws 20 and 54 and providing a wrench brace 80 with apertures 84 spaced sufficiently apart to accommodate the torque arms in position.

In one device constructed in accordance with the teachings of the present invention, a breaking torque of 3500 ft. lbs. can be achieved. The jaws were made with apertures of 2", 2.35", 2.4" and 3". The acme screw of the threaded rod 70 and aperture 66 was ¾" by 6".

Although a single embodiment of the invention has been illustrated in the accompanying drawings, and described in the foregoing detailed description, it will be understood that the invention is not limited to the embodiment disclosed, but is capable of numerous rearrangements, modifications and substitutions of parts and elements without departing from the scope and spirit of the invention.

We claim:

1. A wrench assembly for breaking a threaded connection between a first pipe section and a second pipe section, comprising:

a first jaw engaged to the first pipe section for rotation therewith;

a first torque arm having a proximal end and a distal end, the first torque arm secured to the first jaw at the proximal end;

a second jaw engaged to the second pipe section for rotation therewith;

a second torque arm having a proximal end and a distal end, the second torque arm secured to the second jaw at the proximal end;

a threaded assembly threaded to the first and second torque arms at the distal ends thereof to move the distal ends relative each other to break the threaded joint;

the threaded assembly including a threaded rod and a handle secured thereto, a first pivoting nut pivotally secured to the first torque arm at the distal end thereof and rotatable about a single axis, and a second pivoting nut pivotally secured to the second torque arm at the distal end thereof and pivotal around a single axis, each of said pivoting nuts having a threaded aperture to receive the threaded rod therein, the single axis of pivotal motion of the first and second pivoting nuts providing negation of twisting movement in the torque arms through the engagement of the threaded rod and torque arms.

2. The wrench assembly of claim 1, wherein the threaded rod has acme threads and the threaded apertures of the pivoting nuts have acme threads.

3. The wrench assembly of claim 1, further including a plurality of first pivoting nuts and second pivoting nuts, each of said first and second pivoting nuts having a length different than the other of said pivoting nuts to permit the first and second jaws to be positioned at various distances from each other relative the threaded connection.

4. A method for breaking a threaded connection between a first pipe section and a second pipe section, comprising the steps of:

attaching a first jaw sized to engage the first pipe section for rotation therewith to a first torque arm, the torque arm having a proximal end and a distal end;

attaching a second jaw sized to engage the second pipe section for rotation therewith to a second torque arm, the second torque arm having a proximal end and a distal end;

installing a threaded assembly between the distal ends of the first and second torque arms;

engaging the first pipe section with the first jaw and the second pipe section with the second jaw;

operating the threaded assembly to move the distal ends of the torque arms relative each other to break the threaded joint;

fitting a brace over the first and second torque arms to prevent the torque arms from twisting as the pipe connection is broken.

5. A wrench assembly for breaking a threaded connection between a first pipe section and a second pipe section, comprising:

a first jaw engaged to the first pipe section for rotation therewith;

a first torque arm having a proximal end and a distal end, the first torque arm secured to the first jaw at the proximal end;

a second jaw engaged to the second pipe section for rotation therewith;

a second torque arm having a proximal end and a distal end, the second torque arm secured to the second jaw at the proximal end;

a threaded assembly threaded to the first and second torque arms at the distal ends thereof to move the distal ends relative each other to break the threaded joint;

the first torque arm having a pivot pin aperture formed therein, the first jaw having at least one pivot pin aperture formed therein, the wrench assembly further comprising a first pivot pin pivotally connecting the first jaw to the first torque arm.

6. The wrench assembly of claim 5, wherein the first jaw has a plurality of pivot pin apertures formed therein, the pivot pin passing through a selected one of said plurality of pivot pin apertures to provide a range of adjustment in the pivotal connection between the first jaw and the first torque arm.

7. The wrench assembly of claim 5, further including a plurality of first jaws and second jaws, the jaws sized to engage pipe sections of different diameter.

8. The wrench assembly of claim 5, wherein the first and second pipe sections each define wrench flats proximate the threaded connection, the first jaw having wrench flats engaging the wrench flats on the first pipe section and the second jaw having wrench flats engaging the wrench flats on the second pipe section.

9. The wrench assembly of claim 5 wherein the threaded assembly includes a threaded rod and a handle secured thereto, a first pivoting nut pivotally secured to the first torque arm at the distal end thereof, and a second pivoting nut pivotally secured to the second torque arm at the distal end thereof, each of said pivoting nuts having a threaded aperture to receive the threaded rod therein.

10. The wrench assembly of claim 9, further including a plurality of first pivoting nuts and second pivoting nuts, each of said first and second nuts having a length different than the other of said pivoting nuts to permit the first and second jaws to be positioned at various distances from each other relative the threaded connection.

11. A wrench assembly for breaking a threaded connection between a first pipe section and a second pipe section, comprising:

a first jaw engaged to the first pipe section for rotation therewith;

a first torque arm having a proximal end and a distal end, the first torque arm secured to the first jaw at the proximal end;

a second jaw engaged to the second pipe section for rotation therewith;

a second torque arm having a proximal end and a distal end, the second torque arm secured to the second jaw at the proximal end;

a threaded assembly threaded to the first and second torque arms at the distal end thereof to move the distal ends relative each other to break the threaded joint;

each of the torque arms having a portion with a non-circular cross-section, the wrench assembly further including a brace having a first passage of non-circular cross-section formed therethrough and a second passage of non-circular cross-section formed therethrough, the brace fitted over the first and second torque arms with the portion of the first torque arm passing through the first passage and the portion of the second torque arm passing through the second passage, the brace preventing twisting of the torque arms about the pipe sections as the threaded connection is broken.

12. A wrench assembly for breaking a threaded connection between a first pipe section and a second pipe section comprising:

a first jaw engaged to the first pipe section for rotation therewith;

a first torque arm having a proximal end and a distal end, the first torque arm secured to the first jaw at the proximal end;

a second jaw engaged to the second pipe section for rotation therewith;

a second torque arm having a proximal end and a distal end, the second torque arm secured to the second jaw at the proximal end;

a threaded assembly threaded to the first and second torque arms at the distal ends thereof to move the distal ends relative each other to break the threaded joint;

the first torque arm having a plurality of pivot pin apertures formed therein, the first jaw having at least one pivot pin aperture formed therein, the wrench assembly further comprising a first pivot pin pivotally connecting the first jaw to the first torque arm.

13. A wrench assembly for breaking a threaded connection between a first pipe section and a second pipe section comprising:

a first jaw engaged to the first pipe section for rotation therewith;

a first torque arm having a proximal end and a distal end, the first torque arm secured to the first jaw at the proximal end;

a second jaw engaged to the second pipe section for rotation therewith;

a second torque arm having a proximal end and a distal end, the second torque arm secured to the second jaw at the proximal end;

a threaded assembly threaded to the first and second torque arms at the distal ends thereof to move the distal ends relative each other to break the threaded joint;

each torque arm being formed of a portion having a curved end and plates secured on either side of the portion at the curved end.

14. The wrench assembly of claim 1 wherein the threaded assembly has acme threads.

15. The method of claim 4, further including the step of selecting first and second jaws from a group of various size jaws to fit the first and second pipe sections.

16. The method of claim 4, wherein the step of attaching the first jaw on the first torque arm further includes the step of orienting the first jaw relative to the first pipe section and attaching the first torque arm to the first jaw at a position selected from a plurality of positions for attachment of the first torque arm.

* * * * *